US010314414B2

(12) United States Patent
Tegel

(10) Patent No.: US 10,314,414 B2
(45) Date of Patent: Jun. 11, 2019

(54) UNIBODY FRAME PRESENTATION DEVICE AND METHOD

(71) Applicant: Top Vision Group B.V., Haarlem (NL)

(72) Inventor: Omar Tegel, Haarlem (NL)

(73) Assignee: Top Vision Group B.V., Haarlem (NL)

( * ) Notice: Subject to any disclaimer, the term of this patent is extended or adjusted under 35 U.S.C. 154(b) by 0 days.

(21) Appl. No.: 15/025,025

(22) PCT Filed: Sep. 25, 2014

(86) PCT No.: PCT/NL2014/050655

§ 371 (c)(1),
(2) Date: Mar. 25, 2016

(87) PCT Pub. No.: WO2015/047087

PCT Pub. Date: Apr. 2, 2015

(65) Prior Publication Data

US 2016/0235221 A1 Aug. 18, 2016

(30) Foreign Application Priority Data

Sep. 25, 2013 (NL) ..... 2011500
Jan. 24, 2014 (NL) ..... 2012142

(51) Int. Cl.
*A47F 7/02* (2006.01)
*A47F 7/024* (2006.01)
(Continued)

(52) U.S. Cl.
CPC ..... *A47F 7/0243* (2013.01); *A47F 5/08* (2013.01); *E05B 73/00* (2013.01)

(58) Field of Classification Search
CPC ..... A47F 7/0243; A47F 7/024; A47F 7/02; E05B 73/00; E05B 73/0035
See application file for complete search history.

(56) References Cited

U.S. PATENT DOCUMENTS 3,333,708 A * 8/1967 Leblanc ..... A47F 7/021 211/72
3,567,034 A * 3/1971 Mozelsio ..... A47G 25/0692 211/7

(Continued)

FOREIGN PATENT DOCUMENTS

EP 0220006 A2 4/1987
EP 1582118 A1 10/2005

(Continued)

*Primary Examiner* — Kimberley S Wright
(74) *Attorney, Agent, or Firm* — The Webb Law Firm

(57) ABSTRACT

Disclosed is a spectacle frame presentation device for presenting spectacle frames in a predetermined number of presentation positions in a presentation environment, such as in a shop or at a fair. The device is suitable for an attractive presentation and easy removability of the spectacle frame. The device includes a column body wherein the column body has an elongate form and in a position of use has a relatively narrow front aspect relative to a relatively wide side aspect; and a predetermined number of recesses, such as cut-away portions, for forming respective presentation positions therein. The recesses are preferably formed as side portions cut out of the column body. The column body is a uni-body, preferably formed by means of manufacturing processes for forming an internal space. Also disclosed is a lock-in assembly and a method for manufacturing the spectacle frame presentation device.

15 Claims, 13 Drawing Sheets

(51) Int. Cl.
*A47F 5/08* (2006.01)
*E05B 73/00* (2006.01)

(56) References Cited

U.S. PATENT DOCUMENTS 4,558,788 A * 12/1985 Grothaus ..... A47F 7/021 211/85.1
4,596,334 A * 6/1986 Daulton ..... A47B 81/005 211/4
4,805,781 A * 2/1989 Tegel ..... A47F 7/0243 211/1.51
5,802,891 A * 9/1998 Kahara ..... E05B 65/462 312/333
6,073,781 A * 6/2000 Puglisi ..... B25H 3/04 211/60.1
6,182,840 B1 2/2001 Tegel
6,364,124 B1 * 4/2002 Chen ..... A47F 7/0243 211/4
6,932,224 B1 * 8/2005 Sandberg ..... A47B 81/005 211/70.8
7,134,559 B2 * 11/2006 Zoueki ..... E05B 73/0035 211/85.1
7,270,241 B2 * 9/2007 Nobili ..... A47F 7/0243 211/85.1
7,556,232 B1 * 7/2009 Begg ..... A47F 7/0243 24/3.12
8,307,999 B2 * 11/2012 Pintur ..... A47F 7/0243 211/8
8,573,414 B2 * 11/2013 Winig ..... A47F 7/0243 211/7
8,596,729 B2 * 12/2013 Sabelli ..... E05B 17/04 292/32
8,646,623 B2 * 2/2014 Winig ..... A47F 7/0243 211/7
8,777,020 B2 * 7/2014 Winig ..... A47F 7/0243 211/7
2004/0200790 A1 * 10/2004 Zoueki ..... A47F 7/0243 211/85.1
2005/0211649 A1 9/2005 Nobili
2009/0014604 A1 * 1/2009 Pintur ..... A47F 7/0243 248/158
2013/0037496 A1 * 2/2013 Winig ..... A47F 7/0243 211/4
2015/0150390 A1 * 6/2015 Pintur ..... A47F 7/0243 340/568.8

FOREIGN PATENT DOCUMENTS

WO 9810685 A1 3/1998
WO 2010090511 A1 8/2010

* cited by examiner

UNIBODY FRAME PRESENTATION DEVICE AND METHOD

CROSS-REFERENCE TO RELATED APPLICATIONS

This application is the United States national phase of International Application No. PCT/NL2014/050655 filed Sep. 25, 2014, and claims priority to Dutch Patent Application Nos. 2011500 and 2012142 filed Sep. 25, 2013, and Jan. 24, 2014, respectively, the disclosures of which are hereby incorporated in their entirety by reference.

BACKGROUND OF THE INVENTION

Field of the Invention

The present invention relates to a spectacle frame presentation device for presenting spectacle frames in a predetermined number of presentation positions in a presentation environment, such as in a shop or at a fair, wherein the device is suitable for an attractive presentation and easy removability of the spectacle frame. The present invention also relates to a lock-in assembly for use in a spectacle frame presentation device according to the present invention. The present invention further relates to a method for manufacturing a spectacle frame presentation device according to the present invention.

Description of Related Art

In the selling of spectacles and spectacle frames in the retail trade use is often made of columns for presenting the spectacle frames thereon. Such columns are embodied partially as secured columns and partially as unsecured columns. The security measures in the columns are intended to limit removal of the spectacle frame from the column at the retail trade selling location to situations where salespersons are present.

The manufacture of the prior art presentation columns imposes complex requirements and is labour-intensive since the columns are provided with supporting elements for carrying the spectacle frames and since existing security measures require complex constructions.

SUMMARY OF THE INVENTION

In order to improve this prior art the present invention relates to a spectacle frame presentation device for presenting spectacle frames in a predetermined number of presentation positions in a presentation environment, such as in a shop or at a fair, wherein the device is preferably suitable for an attractive presentation and easy removability of the spectacle frame, the device comprising:

- a column body wherein the column body has an elongate form and in a position of use has a relatively narrow front aspect relative to a relatively wide side aspect,
- a predetermined number of recesses, such as cut-away portions, for forming respective presentation positions therein, wherein the recesses are preferably formed as side portions cut out of the column body,
- wherein the column body is a uni-body, preferably formed by means of manufacturing processes for forming an internal space.

An advantage of a spectacle frame presentation device according to the present invention is that it can be embodied in highly compact dimensions, such as so narrow that it fits between the bridges of a pair of glasses or between the lenses at the edges of the lenses. The spectacle frame can hereby be arranged in the recesses made in the column.

A further result of such a column compared to the prior art is that it can have a very sleek appearance and thereby forms an attractive display in itself. Also an advantage is that such a column, without external features such as support elements for carrying the spectacle frame or visible elements for securing the spectacle frame, places greater emphasis on the spectacle frame to be presented.

A further advantage is that, with a small size of the column such as with the relatively narrow front aspect, a comparatively great stiffness can be realized.

Within the context of the present invention an internal space is defined as the circumscribed space in any aspect of the column body or within continuous maximum dimensional lines of the column body, wherein the volume of the recesses forms part of the internal space.

According to a first preferred embodiment, the spectacle frame presentation device comprises a lock-in assembly, such as a security assembly, for locking the spectacle frame in the recesses, wherein the lock-in assembly comprises a movable lock-in member wherein the lock-in member is movable from a closed position to an opened position via intermediate positions forming a path of movement and wherein at any position the lock-in member is arranged inside the internal space of the elongate body.

A conspicuous advantage of such a preferred embodiment is that a locking is realized for the spectacle frame while no components of the lock-in assembly are visible in the opened position. A significant drawback of columns with prior art security measures is hereby obviated, i.e. that attention is distracted from the presented spectacle frames by visible parts of the security.

A further advantage of such a column according to the present invention is that the security assembly, in particular the lock-in member, because it is invisible does not form a physical obstruction when the spectacle frame is picked up and replaced. This is particularly advantageous for the persons to which the spectacle frame is being presented during comparison of different spectacle frames.

In a further preferred embodiment the internal space in the spectacle frame presentation device is defined as being arranged within circumscribed lines in any aspect of the elongate body. Explicitly defined hereby is that the security assembly and the lock-in member visible in the closed situation are arranged inside the body, thereby achieving the stated advantages.

The column member is more preferably formed by means of an extrusion process, preferably from a metal suitable therefor such as aluminium or a plastic suitable therefor. A column member is hereby realized in advantageous manner which is manufactured from attractive materials imparting a high degree of stiffness in the form of a uni-body, or a hollow. It is a particular insight of the present inventor that, with the exception of the recesses, a body enclosed in top view for the purpose of a column member for the present application particularly imparts an advantageous stiffness, while assembled columns are subject to friction between parts forming the assembly. A further advantage of such a process is that guide elements for guiding for instance the security assembly can be manufactured applying a suitable mould without additional operations.

In a further preferred embodiment the recesses are manufactured by means of milling, more preferably sawing or cutting. A specific advantage of milling is that by means of one operation, when laid flat, all parts to be removed are removed uniformly, whereby the recesses in both side walls are the same.

The column body more preferably forms substantially a rectangle or an oval in top view. A column of such a desired form is hereby provided which has a great stiffness.

A spectacle frame presentation device according to the invention more preferably comprises a rear side attaching member, preferably embodied as a channel or groove, for attaching sidepiece holders thereto, preferably by means of a rotation snap coupling or bayonet coupling, and/or for attaching a wall connection thereto and/or for attaching a control assembly thereto.

An advantage hereof is that such a provision can be manufactured in suitable manner without additional operations while during regular use it is out of sight and while the stated functionalities are therefore provided in unobtrusive manner.

In a further preferred embodiment the column body comprises coupling means for coupling to a control assembly. Hereby realized is that different forms of operation can be coupled in advantageous manner to one and the same column by means of the coupling means. Great advantages can hereby be gained in production efficiency, stock control and in the marketing chain.

The control assembly is therefore preferably suitable for manual operation or for motorized operation of the spectacle frame presentation device. Manual operation can be controlled by means of a key with an actuating handle, while a motorized operation can be controlled by means of push-button control or by means of a remote control.

Such methods of control for columns for presenting spectacle frames are per se known, although the present invention adds to the prior art that the control assembly can be manufactured, distributed and later mounted independently of the column. It is also possible according to the present invention to convert a column initially supplied as manually operated column to a remotely controllable column by means of relatively simple replacement of the control assembly.

Drive means preferably integrated into the control assembly are more preferably arranged outside the column body for driving the lock-in assembly.

In alternative manner the uni-body is formed by means of welding and/or gluing two elongate body parts to each other.

A further aspect according to the present invention relates to a lock-in assembly for use in a spectacle frame presentation device according to one or more of the foregoing claims, comprising:

- a frame for arranging in an internal space of the column body,
- a lock-in member movable relative to the frame,
- a displacing member arranged movably relative to the frame for the purpose of displacing the lock-in member, and
- coupling means for coupling displacing members of lock-in assemblies arrangeable adjacently relative to each other.

Using such a lock-in assembly it becomes possible according to the present invention to apply an array of such lock-in assemblies in a column member according to the present invention, wherein it is only necessary to provide an actuation for the movement from one side. Repair or replacement of a lock-in assembly is relatively simple because the array of lock-in assemblies can be easily removed from the column.

According to a preferred embodiment the lock-in assembly comprises positioning means for relative positioning of lock-in assemblies arrangeable adjacently relative to each other. A precise relative orientation of the displacing members can be realized by means of such positioning means.

The lock-in assembly more preferably comprises fixation coupling means for fixing the lock-in assembly relative to the column body and/or a recess thereof by means of coupling with a lock-in assembly fixation member. Simple fixation of the lock-in assembly relative to the column body can hereby be realized in advantageous manner. A method of assembly hereby also becomes possible wherein, by means of simple snap-in of the fixation coupling means following correct positioning of the lock-in assembly, a lock-in assembly or a complete array of lock-in assemblies can be fixed in simple manner.

The lock-in assembly more preferably comprises guide means, such as guide openings, for guiding and supporting the lock-in member. Reliable operation is on the one hand hereby realized by means of movement of the displacing member. High security is on the other hand hereby realized in that in the closed position thereof the lock-in assembly is held on the underside and the upper side in firm manner in the guide openings. The spectacle frames are hereby located securely in the spectacle frame position when the lock-in member is in the closed position.

For the purpose of manufacturing the displacing member in advantageous and sturdy manner a forming process such as injection moulding is more preferably applied, wherein during and/or by means of the forming process the lock-in member is preferably fixed to the displacing member. The displacing member with the lock-in member arranged and fixed therein can hereby be provided as a component during assembly of the lock-in assembly. A firm mounting of the lock-in member on the displacing member can also hereby be realized.

A further aspect according to the present invention relates to a spectacle frame presentation device comprising a lock-in assembly according to the present invention.

In a further preferred embodiment the coupling means of a lower or upper lock-in assembly are connectable to the control assembly. Hereby made possible in advantageous manner is that the control assembly is coupled functionally to the column body with the lock-in assemblies arranged therein. The stated advantage of the interchangeability of manually operated or motor-operated control assemblies is hereby also realized.

Damping means are more preferably provided for damping a movement in the path of movement. It hereby becomes possible to apply a biasing member so that a manually operated column can also open or close in controlled manner.

The spectacle frame presentation device more preferably comprises releasable cylinder lock holding means. It is envisaged here that the user of the device can him/herself easily arrange a cylinder. This provides very great advantages because cylinders can be supplied separately of the rest of the device, whereby individual keys can be applied or advantageous key closing plans can be applied instead of simply a standard key for stock control of per se known built-in cylinders. In the case of an incident calling for this measure, such as loss or theft of a key, the user can hereby also replace one or more cylinders. It also becomes possible for instance by means of a key closing plan to give determined employees access to determined columns and to give determined employees access to other columns or all columns.

A further preferred embodiment comprises a lock-in assembly fixation member for fixing a lock-in assembly relative to a respective recess.

The spectacle frame presentation device more preferably comprises a spectacle frame support member arrangeable relative to a recess, wherein the spectacle frame support member is preferably integrated with the lock-in assembly fixation member.

Using these latter preferred embodiments a lock-in assembly can be fixed in advantageous manner during assembly. It is also possible to change the shape of the spectacle frame support member by placing a different one. By replacing one or more spectacle frame support members a distinction can be made between different columns in a shop, or a shop as a whole can be provided with a distinctive character while the advantages of the spectacle frame presentation device according to the present invention are retained.

A further aspect according to the present invention relates to a method for manufacturing a spectacle frame presentation device according to one or more of the foregoing claims, comprising steps for:

- forming a uni-body with an internal space, preferably by means of an extrusion process, more preferably by means of an injection moulding process,
- arranging recesses such as portions cut away from a side, preferably by means of a milling process or a cutting process.

Advantages of this aspect relate to the realizing of a compact but very stiff column member construction as well as realizing many advantages of other aspects according to the invention as described in the foregoing.

According to a further preferred embodiment the method comprises steps for:

- providing an array of lock-in assemblies for the purpose of enabling locking of respective recesses,
- placing the array of lock-in assemblies into the internal space,
- fixing the array of lock-in assemblies by means of at least one lock-in assembly fixation member.

Following the forming, steps are more preferably implemented for performing a surface treatment such as lacquering, enameling, anodizing, this step preferably being performed prior to arranging of the recesses.

Hereby realized in advantageous manner is that it is not necessary to take into account the later positioning of the recesses when the surface treatment is carried out.

BRIEF DESCRIPTION OF THE DRAWINGS

Further advantages, features and details of the present invention will be described in greater detail hereinbelow on the basis of one or more preferred embodiments with reference to the accompanying figures. Similar, though not necessarily identical, components of different preferred embodiments are designated with the same reference numerals. With the object of limiting the number of views different aspects of different preferred embodiments are shown combined.

DETAILED DESCRIPTION OF THE INVENTION

Figure 1:
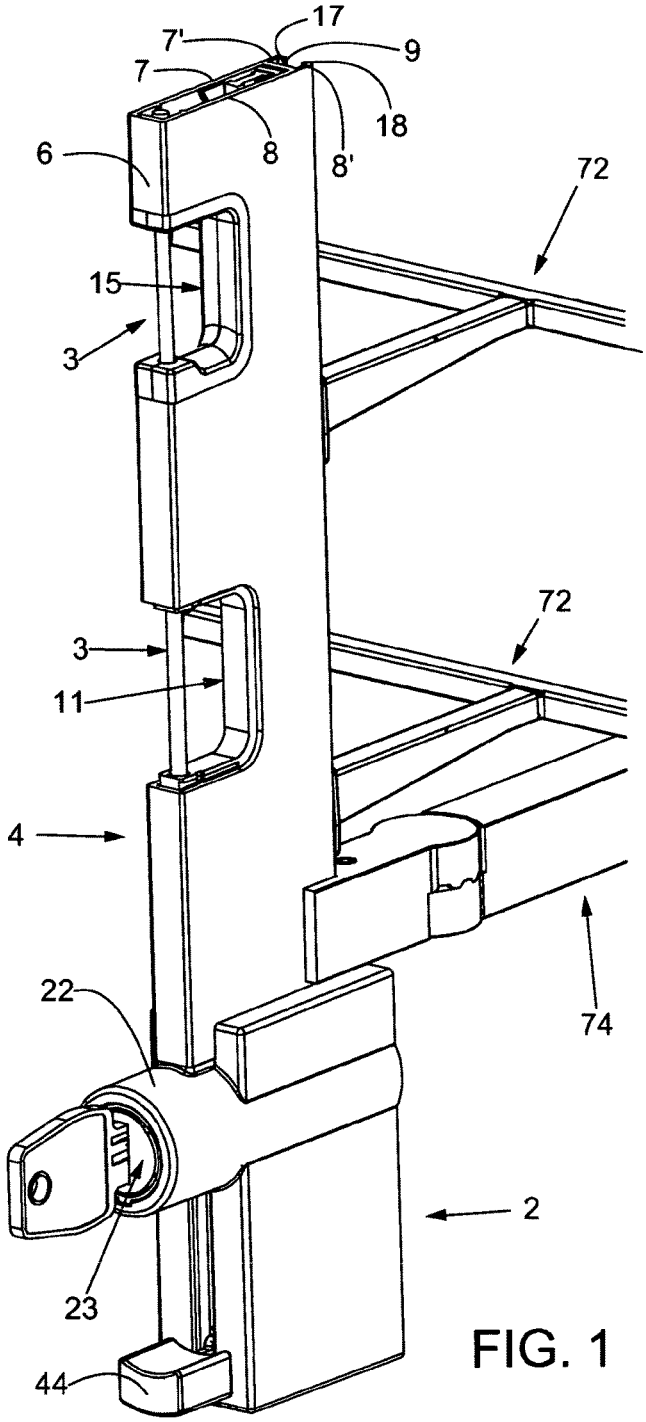
FIG. 1 shows a partially cut-away isometric view of a first preferred embodiment according to the present invention with a manual control.
Figure 2:
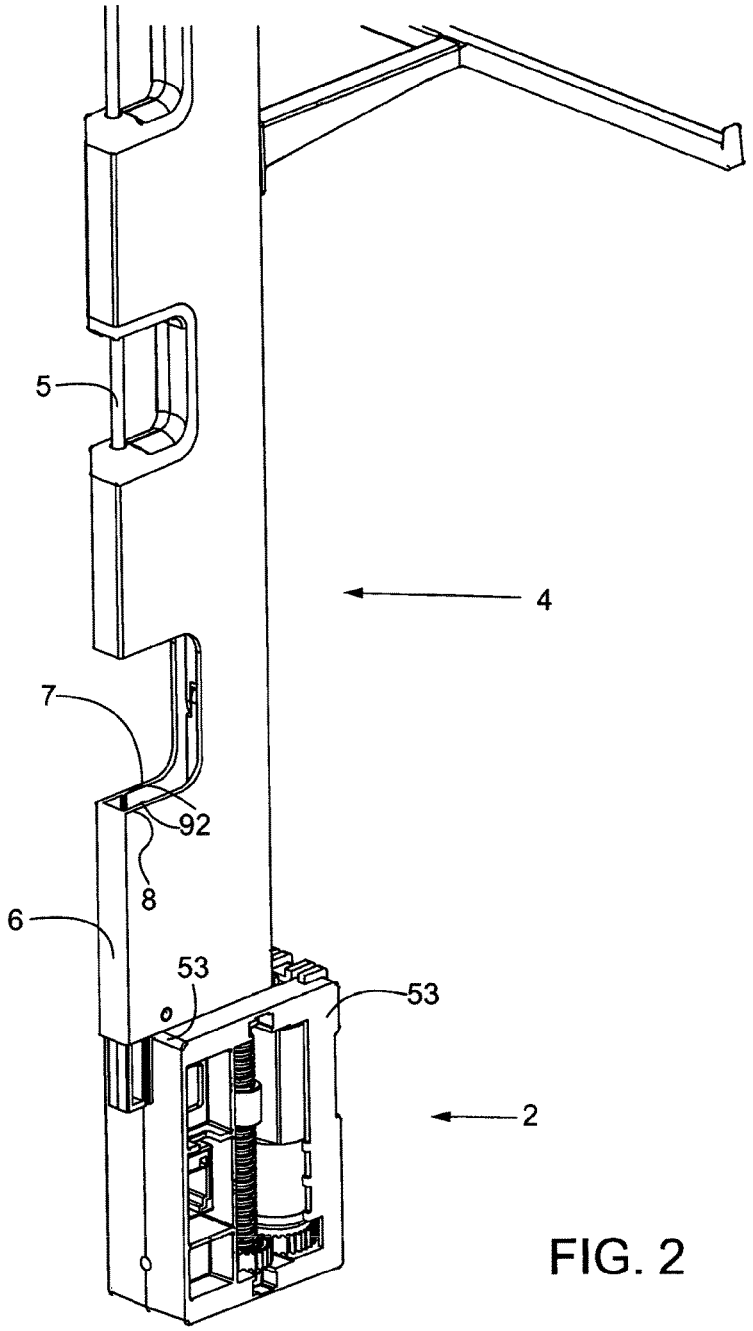
FIG. 2 shows a partially cut-away isometric view of a further preferred embodiment according to the present invention with a motor control.
Figure 3:
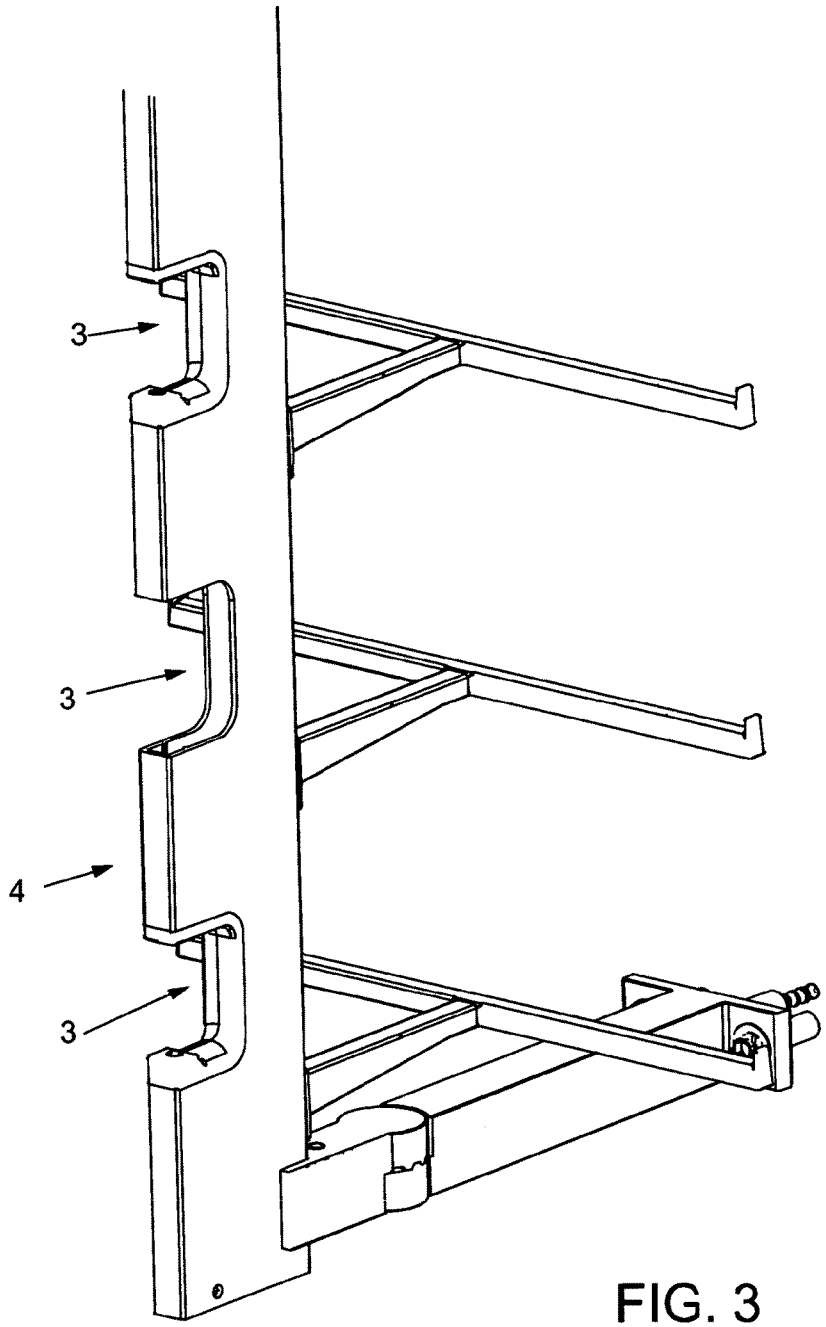
FIG. 3 shows a partially cut-away isometric view of a further preferred embodiment according to the present invention.
Figure 7A:
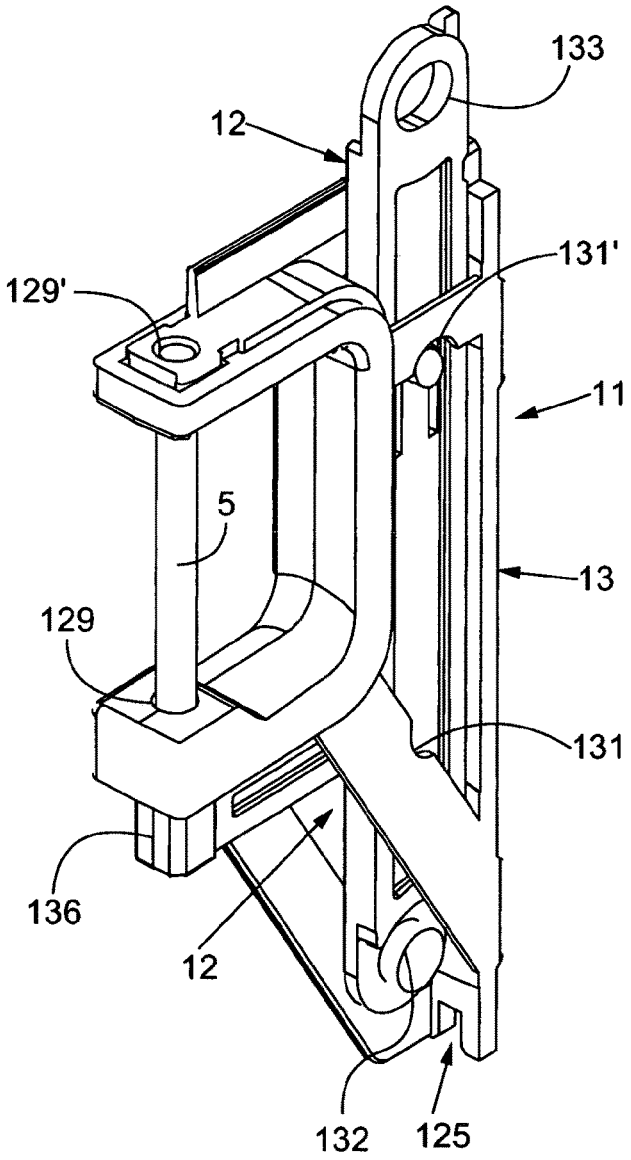
FIG. 7A-C show three views of a preferred embodiment of a lock-in assembly according to the present invention.
Figure 7B:
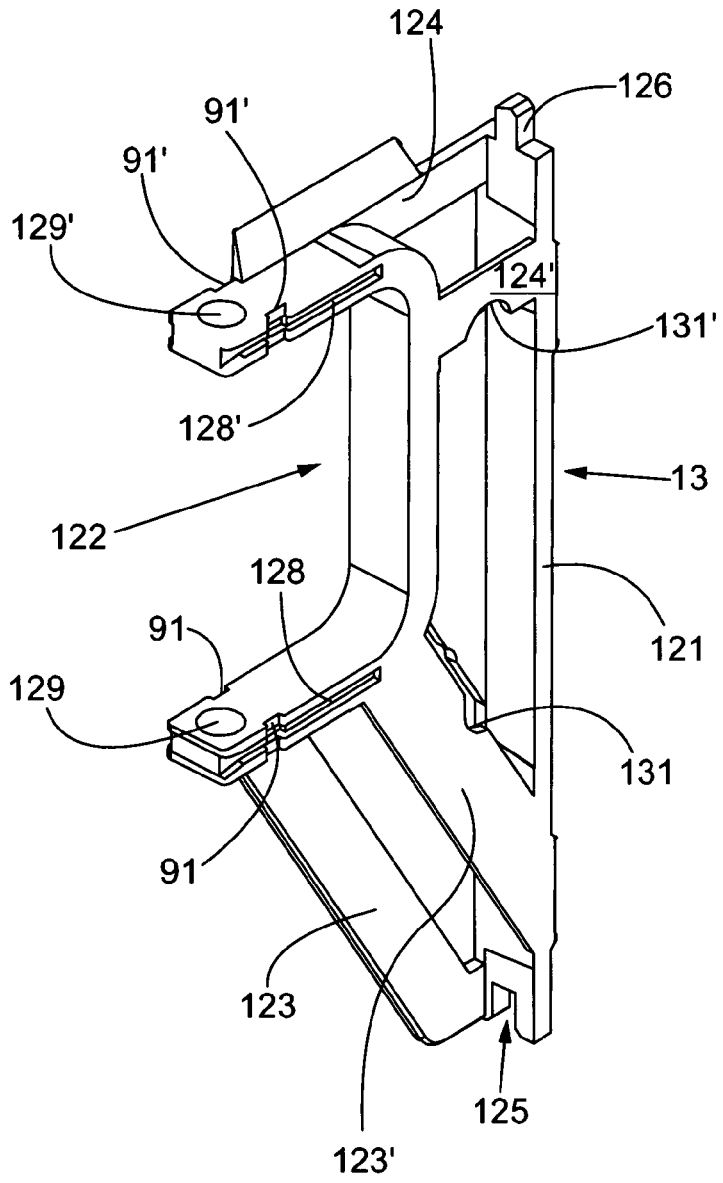
Figure 7C:
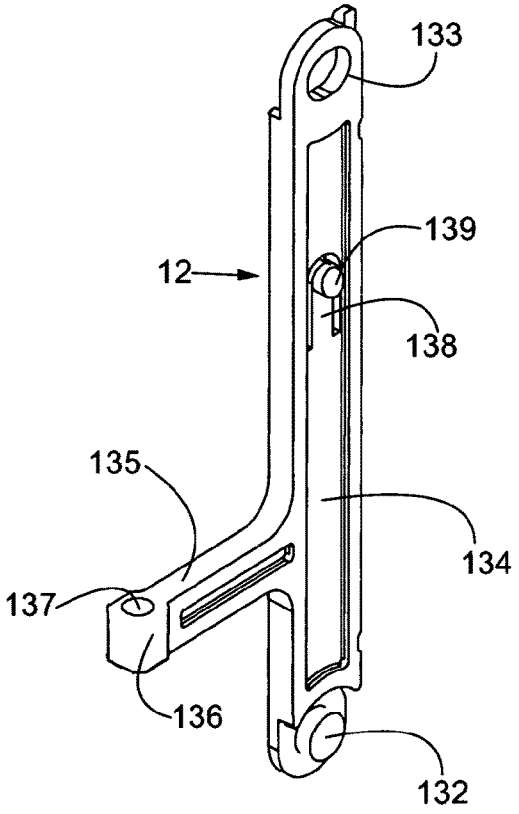

A first preferred embodiment (FIG. 1) according to the present invention relates to a spectacle frame presentation device 1. This comprises a column body 4 provided with a recesses 3 for receiving spectacle frames (not shown). Arranged for each recess 3 on the rear side of the column body is a sidepiece support 72 for supporting the sidepieces of the spectacle frames to be presented. Arranged on the underside of column body 4 is a control assembly which, depending on the preferred embodiment, is a manually operated assembly (FIG. 1) or a motor-operated assembly (FIG. 2). The control assemblies are described in greater detail hereinbelow. Arrangeable in the column body is an array of lock-in assemblies 11 which are described in greater detail with reference to FIG. 7.

The column body is manufactured by means of an extrusion which realizes an inner space enclosed by walls 6, 7, 9. Realized on walls 7, 8 in the inner space is a guide edge 92 for the purpose of guiding and/or positioning a lock-in assembly or an array thereof. A mounting channel is realized on the rear side of column body 4 by means of wall extensions 7', 8' and edges or wall parts 17, 18 extending substantially perpendicularly thereof. This mounting channel serves for mounting of sidepiece supports 72.

Figure 4:
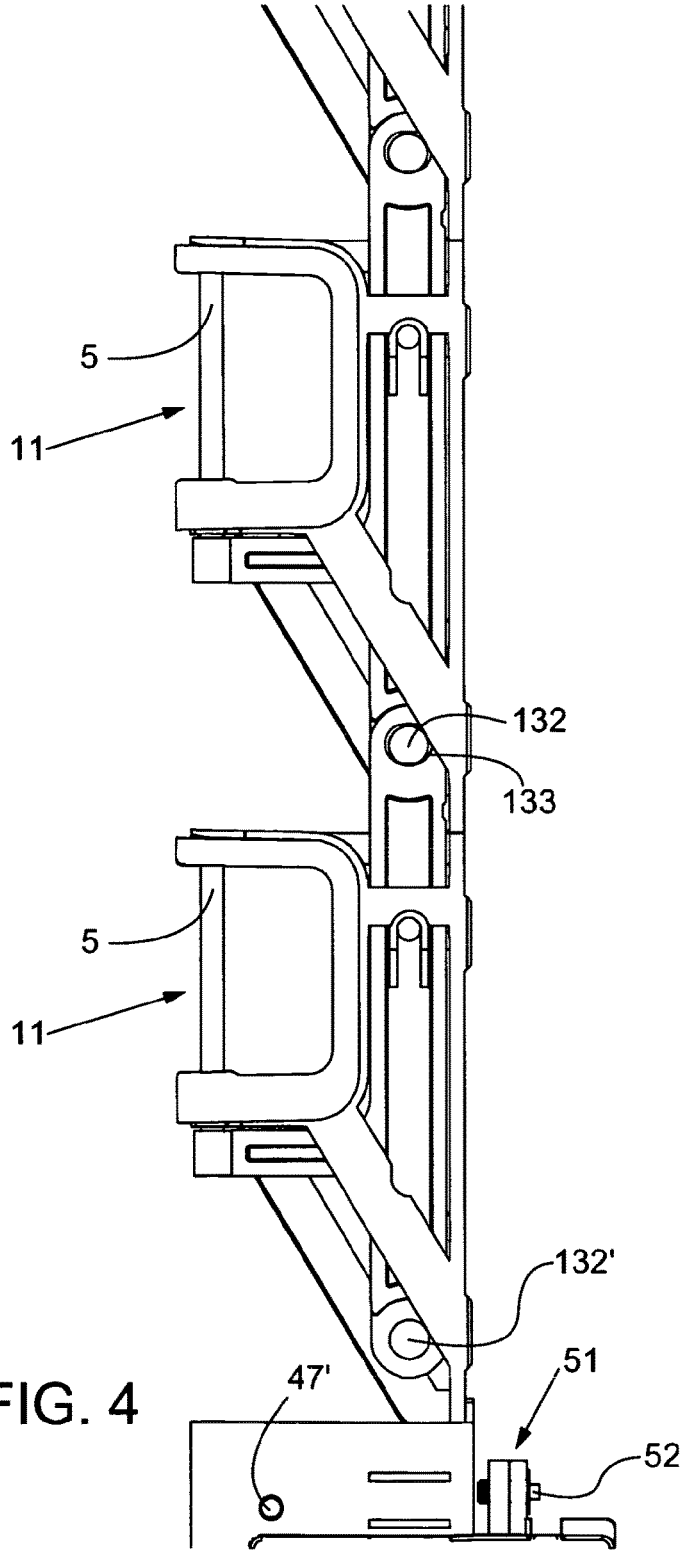
FIG. 4 shows a partially cut-away side view of the preferred embodiment according to FIG. 2.

FIG. 4 shows a modified arrangement of an array of a number of lock-in assemblies 11 with omission of the column body. The mounting channel also functions for the purpose of fixing the control assembly by means of a mounting block 51 comprising a screw opening and a screw 52. This mounting method functions for both the manual and the motor variant. A further point of attachment of the control assembly is by means of a screw in screw openings 53 in wall 8, the screw extending in mounting opening 47'.

FIG. 5 shows three situations of the lock-in assemblies in combination with the motor variant of the control assembly. FIG. 5A shows a closed position of the lock-in assembly. FIG. 5B shows an intermediate position between the closed position and the opened position. FIG. 5C shows an opened position of the lock-in assembly. FIG. 5D shows another view of the situation of FIG. 5A.

Figure 5A:
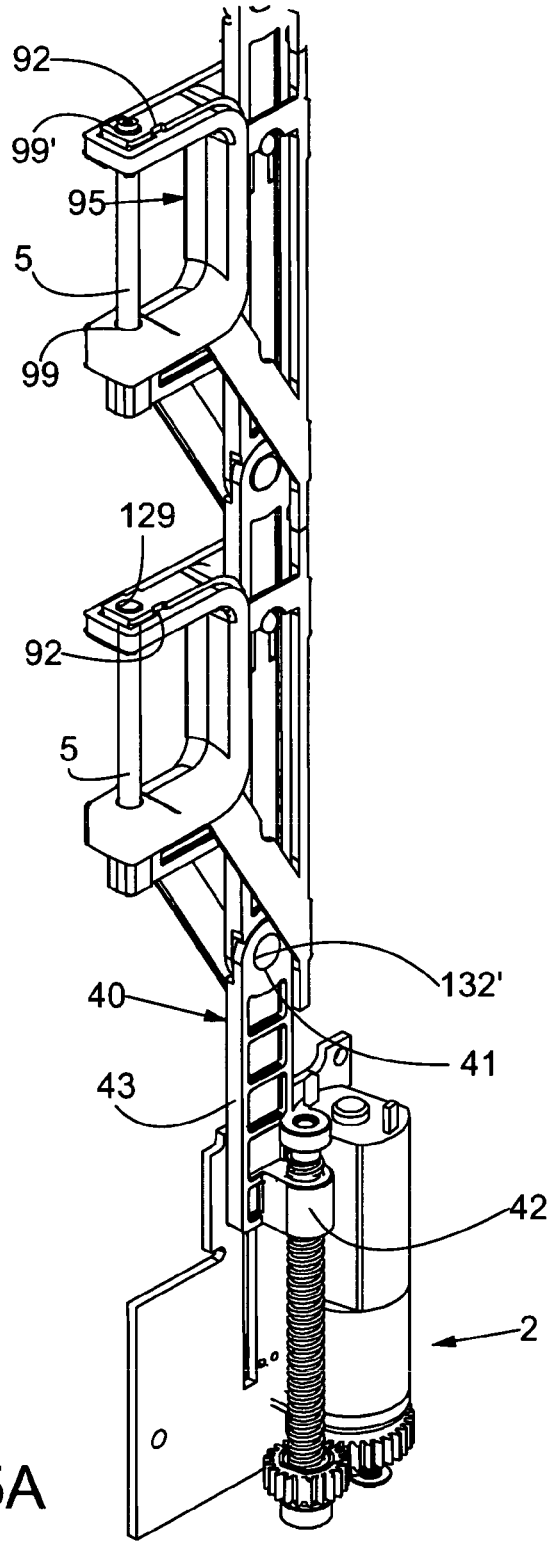
FIG. 5A-D show four views of the embodiment according to FIG. 2 at different stages of movement of the lock-in member.
Figure 5B:
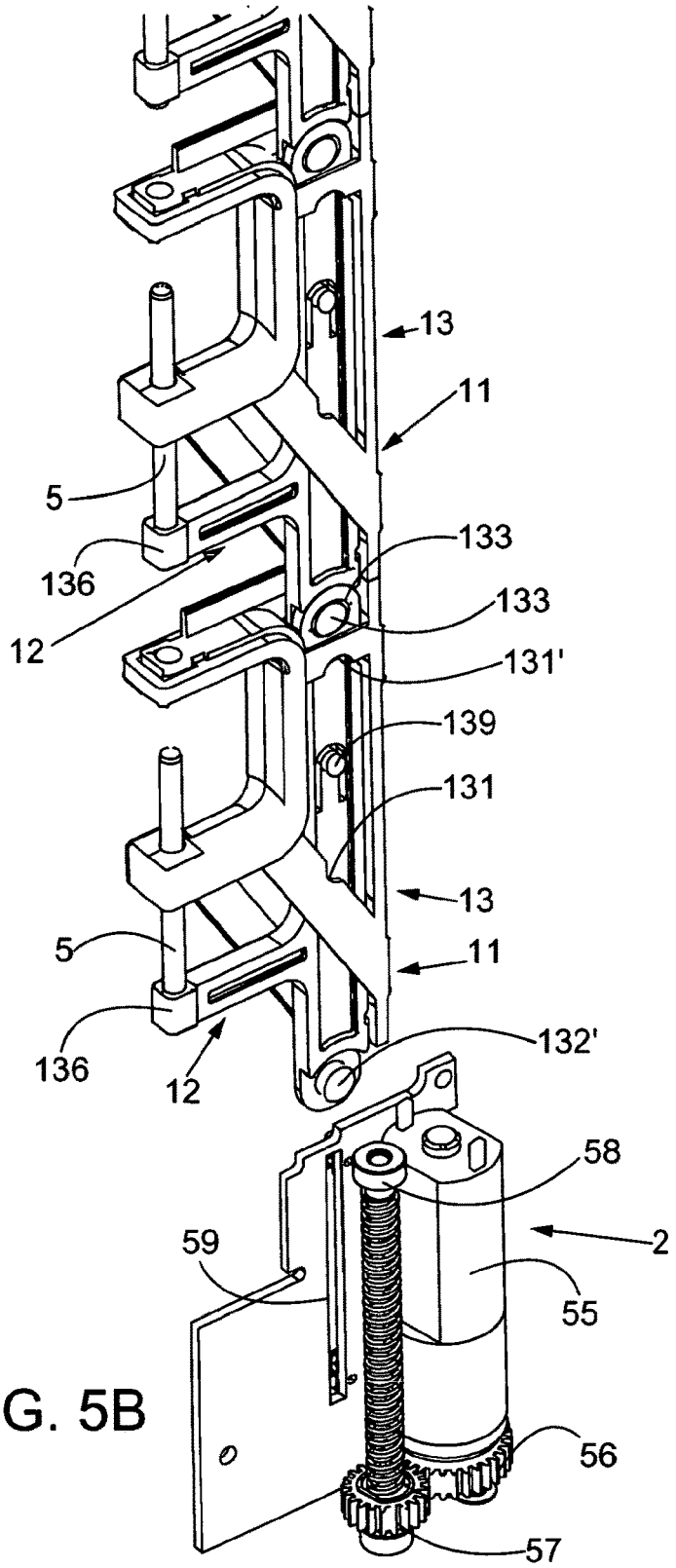
Figure 5C:
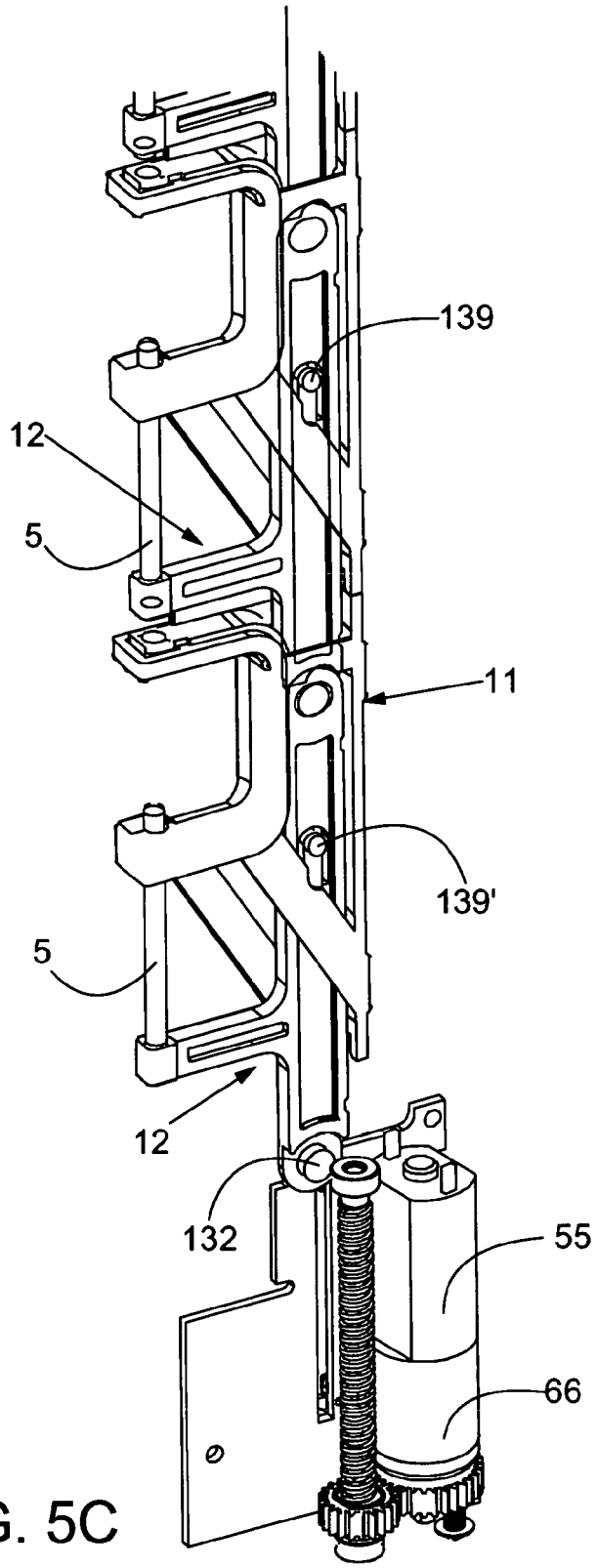
Figure 5D:
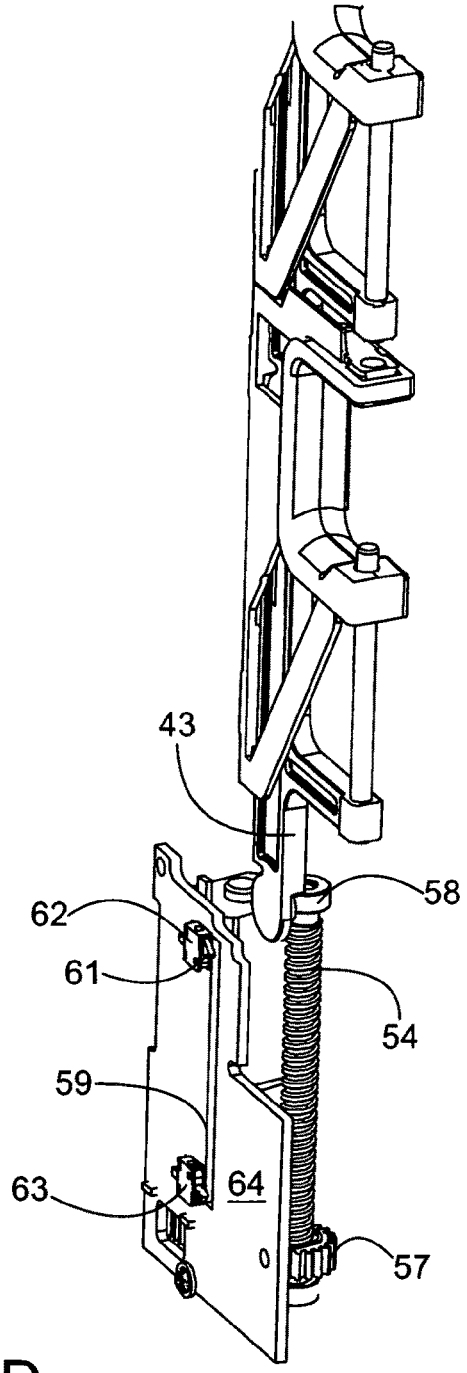

A drive member 40 for driving the lower lock-in assembly is shown in Fig. A, D while being omitted in FIG. 5B and FIG. 5C. This drive member serves to couple the spindle 54 to the lower lock-in assembly. Drive member 40 comprises for this purpose a frame 43, a coupling opening 41 on the upper side thereof and a spindle coupling block 42 provided internally with thread. Motor 55, which is mounted on printed circuit board 64, is coupled to the spindle by means of a gear assembly 56, 57. The motor is also provided with a transmission 66.

Frame 43 is provided with an actuator arm 61 which extends through a slot 59 of printed circuit board 64. Sensors 62, 63 for the purpose of controlling the motor are provided at the ends of slot 59. The distance between the locations of the sensors corresponds to the distance the lock-in members 5 move.

Lock-in assembly 11 (FIG. 5, 7 in greater detail) comprises a frame, i.e. a frame part 13, and a displacing member, i.e. a moving part 12. Frame part 13 serves for the purpose of arranging lock-in assembly 11 in column body 4. The frame part comprises a vertical element 121 with supports 123, 123' extending therefrom for supporting a lower side of a substantially C-shaped frame element 122. Situated on the upper side of vertical element 121 are substantially horizontally arranged supports 124, 124' for forming a connection to substantially the upper side of the substantially C-shaped frame element 122.

The substantially C-shaped frame element 122 has two lock-in member guide openings 129, 129' arranged respectively on the lower side and the upper side. The strength of a locking is realized by the lock-in member 5 engaging in the closed situation on both the lower guide opening 129 and the upper guide opening 129'. The locking is further improved in that the lock-in member engages in the closed situation on guide openings 99, 99' of fixation element 15.

Provided for co-action with the lock-in assembly fixation member 15 are coupling slots 128, 128' which co-act with coupling protrusions 92 thereof. Also provided are guide grooves 91, 91' for co-action with guide edges 92 arranged on the inner side of walls 7, 8 of the column body.

Vertical element 121, a vertical part of the C-shaped element, supports 123, 123', 124, 124' form in top view a guide channel for a vertical element 134 of the moving part 12. This vertical element 134 has a stop 139 protrusion which for the purpose of assembly can be moved or pressed aside by means of a bridge 138. This stop protrusion 139 co-acts with stop spaces 131, 131' of supports 123', 124'.

The moving part 12 also comprises an arm 135 which is horizontal during use and has a mounting block 136 with an opening 137 for holding lock-in member 5. The moving part comprises a coupling protrusion 132 at the bottom and a coupling opening 133 at the top. A coupling protrusion 132 of a moving part arranged higher in the column body co-acts when assembled with a coupling opening 133 of an adjacent moving part arranged in lower position. Coupling protrusion 132 of the lower moving part in a column body co-acts with opening 132' of drive member 40. It is envisaged in alternative manner that a coupling opening 133 can co-act with a drive assembly arranged above the column.

The control assemblies arranged on the underside of the column each have an outer housing 53 and a frame 40 arranged inside this outer housing. This frame serves to support the components of the control assemblies and for coupling thereof to column body 4 by means of the described means 51, 51 and opening 47'. The outer housing is slidable forward off the frame 55 and has for this purpose an open rear side not visible during use. A fixation bolt 51 co-acting with an opening (not shown) in the underside of the outer housing serves for fixation of the outer housing.

Figure 6A:
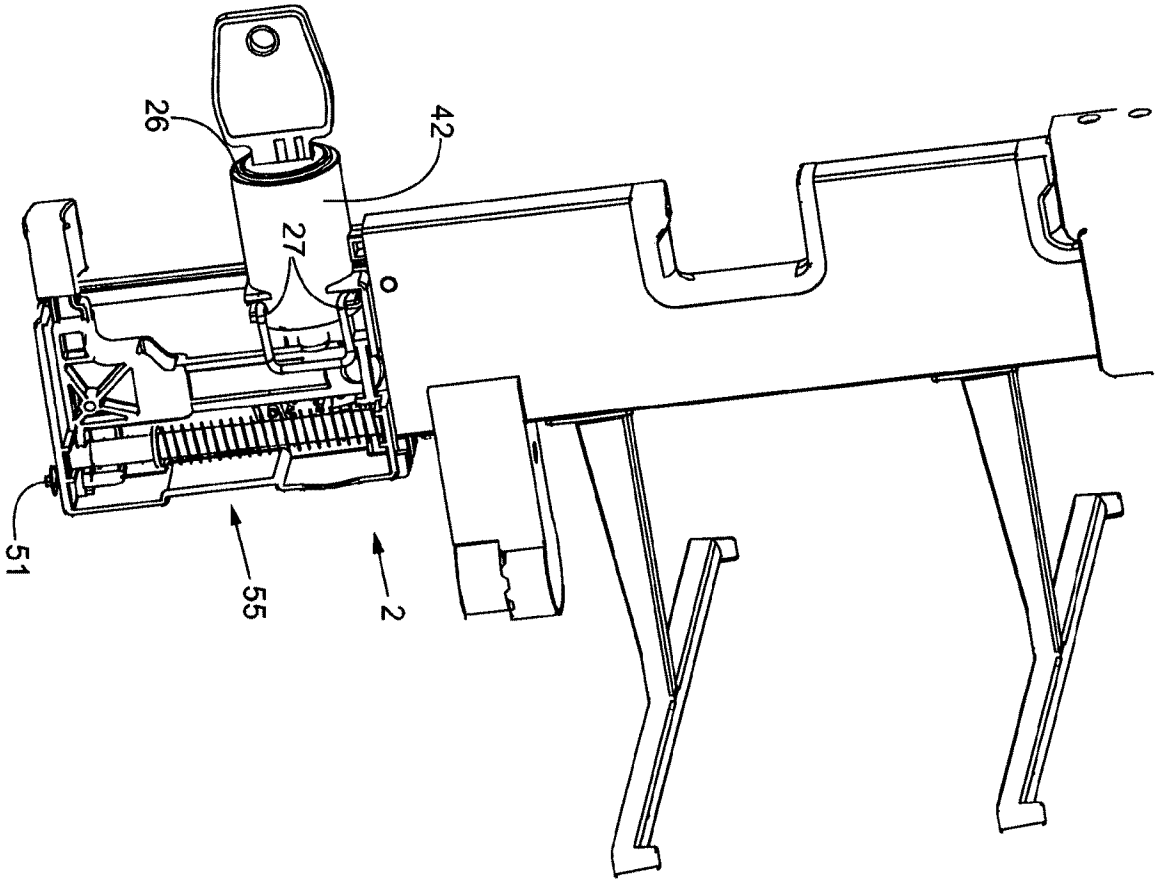
FIG. 6A-B show two views of the preferred embodiment according to FIG. 1 in partially cut-away state.

FIG. 6A shows frame 55 for the hand-operated variant which has a cylinder housing 42 for placing therein of the cylinder lock 23 with a cylinder housing 32. This cylinder housing has a rotation-limiting protrusion 26 on the underside thereof for co-action with a rotation-limiting slot 26 on the underside of cylinder housing 42 of the frame. Arranged substantially close to the rear side of cylinder housing 42 are two throughfeed channels 27 for placing therethrough fixation parts 43, 43' of a mounting spring 31. When mounting spring 31 is arranged with fixation parts 43, 43' in throughfeed channels 27, the cylinder lock can be placed and immediately fixed by sliding the cylinder housing in the cylinder housing. During this operation the chamfered spring-displacing surfaces 28 urge the fixation parts 43, 43' of the spring outward, wherein fixation parts 43, 43', when slid further, snap into the respective slots of the cylinder housing to complete the mounting of the cylinder locks. The cylinder locks can then only be removed after removal of the outer housing and after the fixation parts 43, 43' held under bias have been urged apart mechanically. Hereby realized is that cylinders can be easily placed and can be replaced or exchanged as required.

Figure 6B:
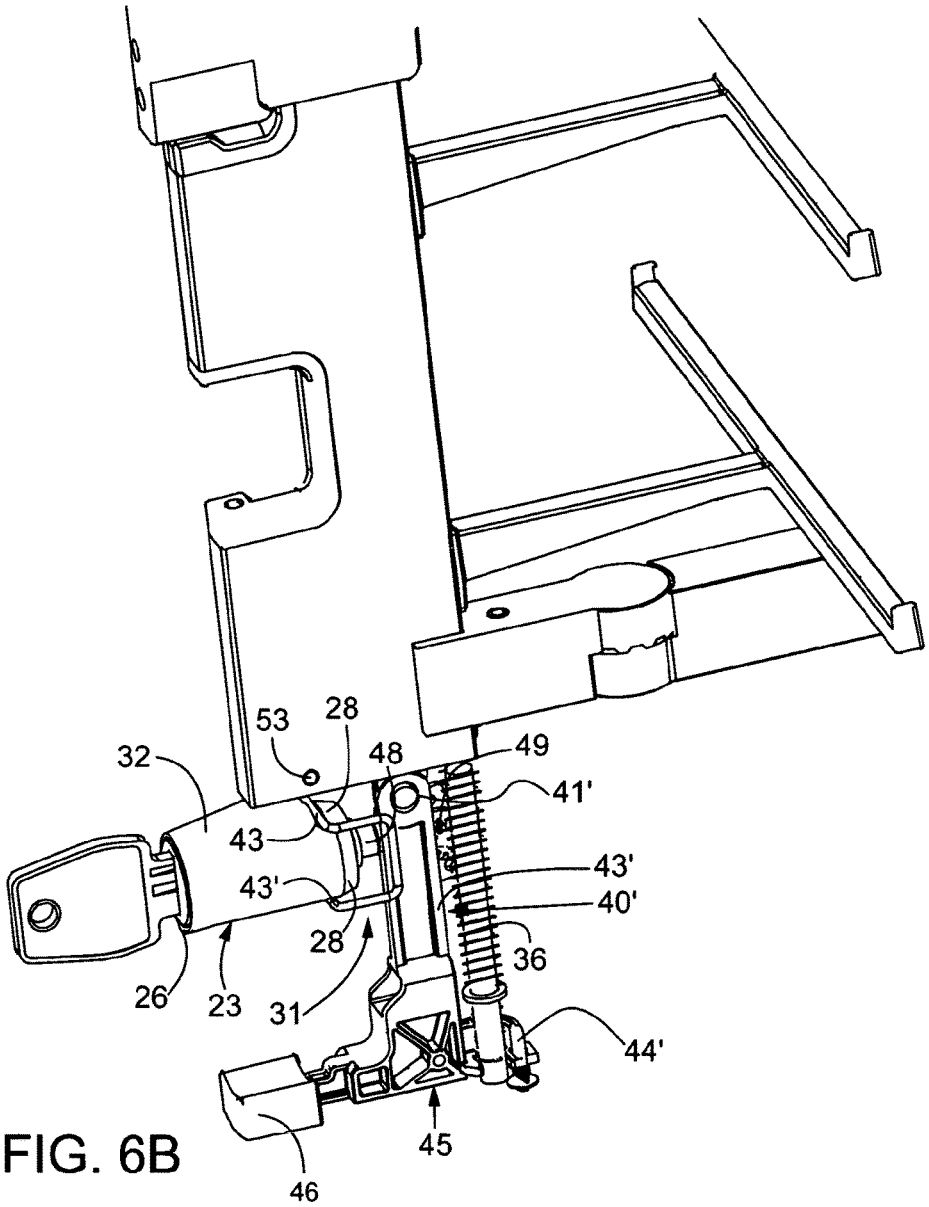

The control assembly according to FIG. 6 also comprises a drive member 40 for driving the lock-in assembly by means of coupling to protrusion 132' of the lower moving part 12 by means of opening 41'. Drive member 40 is connected for this purpose to handle 44 by means of a coupling frame 45. When the key of the cylinder lock is rotated the cylinder actuator 48 is retracted, whereby drive member 40 can move freely up and downward. Push spring 46 then pushes frame part 44' downward in the direction of arrow A, whereby the lock-in assemblies open and each respective lock-in member moves downward. This movement is braked by the rotating decelerating assembly 49 which is coupled by means of a gear wheel to a linear toothing (not shown) on drive member 40. When handle 46 is moved manually upward, the assembly moves in the direction of arrow A' and the spring is once again placed under bias.

Control assembly according to the present invention comprising a placing position for a cylinder lock comprising preferably engaging means for a fixing member such as a clamping spring, a fixing member arrangeable relative to the placing position for the cylinder lock, wherein the control assembly is suitable for mountably receiving the cylinder lock by means of a slide-in operation, wherein during the slide-in operation the fixing member is brought into engagement with the engaging means of the cylinder lock.

Control assembly as above wherein the fixing member is arranged under bias and wherein during placing of the cylinder lock the fixing member gives way counter to the bias under the influence of the engaging means, and more preferably engages in snap-fixed manner on the engaging means under the influence of the bias.

Within the understanding of the skilled person and in the context of the present invention a uni-body is a fused unit which cannot be separated into individual mountable components.

The present invention has been described in the foregoing on the basis of several preferred embodiments. Different aspects of different embodiments are deemed described in combination with each other, wherein all combinations which can be deemed by a skilled person in the field as falling within the scope of the invention on the basis of reading of this document are included. These preferred embodiments are not limitative for the scope of protection of this document. The rights sought are defined in the appended claims.

The invention claimed is:

1. A spectacle frame presentation device for presenting spectacle frames in a predetermined number of presentation positions in a presentation environment wherein the device is suitable for presentation and removability of the spectacle frame, the device comprising:

a column body wherein the column body has an elongate form and, in a position of use, a narrow front aspect and a wide side aspect, a predetermined number of recesses for forming respective presentation positions therein, wherein the recesses are formed as cut-away portions that are cut out of the column body; and a lock-in assembly for locking the spectacle frame in the recesses, wherein the lock-in assembly comprises a movable lock-in member movable from a closed position to an opened position via intermediate positions forming a path of movement and wherein at any position the lock-in member is arranged inside an internal space of the elongate body, wherein the lock-in member is fully withdrawn in the internal space of the elongate body of the frame in the opened position, wherein the column body is a uni-body formed by means of manufacturing processes for forming the internal space, and wherein the spectacle frame is supportable within the recesses of the uni-body such that, when supported, a bridge of the spectacle is placed in the recess of the uni-body with two glass holding portions of the spectacle extending sideways of the uni-body.

2. The spectacle frame presentation device as claimed in claim 1, wherein the internal space is defined as being arranged within circumscribed lines in any aspect of the elongate body.

3. The spectacle frame presentation device as claimed in claim 1, wherein the column member is formed by means of an extrusion process from a metal material or a plastic material.

4. The spectacle frame presentation device as claimed in claim 1, wherein the recesses are manufactured by means of milling, sawing, or cutting.

5. The spectacle frame presentation device as claimed in claim 1, wherein the column body forms substantially a rectangle or an oval in top view.

6. The spectacle frame presentation device as claimed in claim 1, further comprising a rear side attaching member embodied as a channel or groove.

7. The spectacle frame presentation device as claimed in claim 1, wherein the column body comprises coupling means for coupling to a control assembly.

8. The spectacle frame presentation device as claimed in claim 1, further comprising a control assembly, wherein the control assembly is suitable for manual operation or for motorized operation of the spectacle frame presentation device.

9. The spectacle frame presentation device as claimed in claim 8, wherein drive means integrated into the control assembly are arranged outside the column body for driving a lock-in assembly.

10. The spectacle frame presentation device as claimed in claim 1, wherein the uni-body is formed by means of welding and/or gluing two elongate body parts to each other.

11. The spectacle frame presentation device as claimed in claim 8, wherein displacing coupling means of a lower or upper lock-in assembly are connectable to the control assembly.

12. The spectacle frame presentation device as claimed in claim 1, further comprising damping means for damping a movement in the path of movement.

13. The spectacle frame presentation device as claimed in claim 1, further comprising releasable cylinder lock holding means.

14. The spectacle frame presentation device as claimed in claim 1, further comprising a lock-in assembly fixation member for fixing a lock-in assembly relative to a respective recess.

15. The spectacle frame presentation device as claimed in claim 14, further comprising a spectacle frame support member arrangeable relative to a recess, wherein the spectacle frame support member is integrated with the lock-in assembly fixation member.

* * * * *